United States Patent [19]

Cribiu et al.

[11] Patent Number: 4,948,498

[45] Date of Patent: Aug. 14, 1990

[54] SEPARATING DRUM

[75] Inventors: Oreste Cribiu; Leo Cribiu, both of Gerenzano, Italy

[73] Assignee: Eva Fin s.r.l., Milan, Italy

[21] Appl. No.: 322,170

[22] Filed: Mar. 13, 1989

[30] Foreign Application Priority Data

Mar. 11, 1988 [DE] Fed. Rep. of Germany ..... 3808215

[51] Int. Cl.[5] ..... B07B 1/18; B07B 13/04

[52] U.S. Cl. ..... 209/664; 209/288; 209/668

[58] Field of Search ..... 209/621, 664, 625, 626, 209/667, 668, 683, 676, 288, 294

[56] References Cited

U.S. PATENT DOCUMENTS

| | | | |
|---|---|---|---|
| 1,512,240 | 10/1924 | Ryan et al. | 209/676 X |
| 2,984,351 | 5/1961 | Van Slyck et al. | 209/664 X |
| 3,055,500 | 9/1962 | Aubert-Maguero | 209/288 |
| 3,831,752 | 8/1974 | Holloway | 209/394 |
| 4,149,637 | 4/1979 | Starr | 209/668 X |

FOREIGN PATENT DOCUMENTS

| | | | |
|---|---|---|---|
| 169929 | 6/1965 | U.S.S.R. | 209/664 |
| 2132116 | 7/1984 | United Kingdom | 209/668 |

*Primary Examiner*—Donald T. Hajec

*Attorney, Agent, or Firm*—Barnes & Thornburg

[57] ABSTRACT

A separating drum, having a multiple of cylindrically shaped separating elements, which are arranged parallel to the axis of rotation of the drum is provided with an arrangement by which a single part can be moved to form an adjustable separating slot. The separating drum includes separating elements which are firmly connected in pairs respectively by at least one carrier element, which is provided on one of the front faces of the separating elements. The carrier element can be rotated around the axis of a cylindrically shaped separating element situated on the circumference of the drum. Further, an adjusting wheel is provided which can be driven by a circulating adjusting element for setting the separating slot, the adjusting wheel having an axis of rotation on at least one of the front faces of the stationary separating element.

10 Claims, 3 Drawing Sheets

FIG. 1a
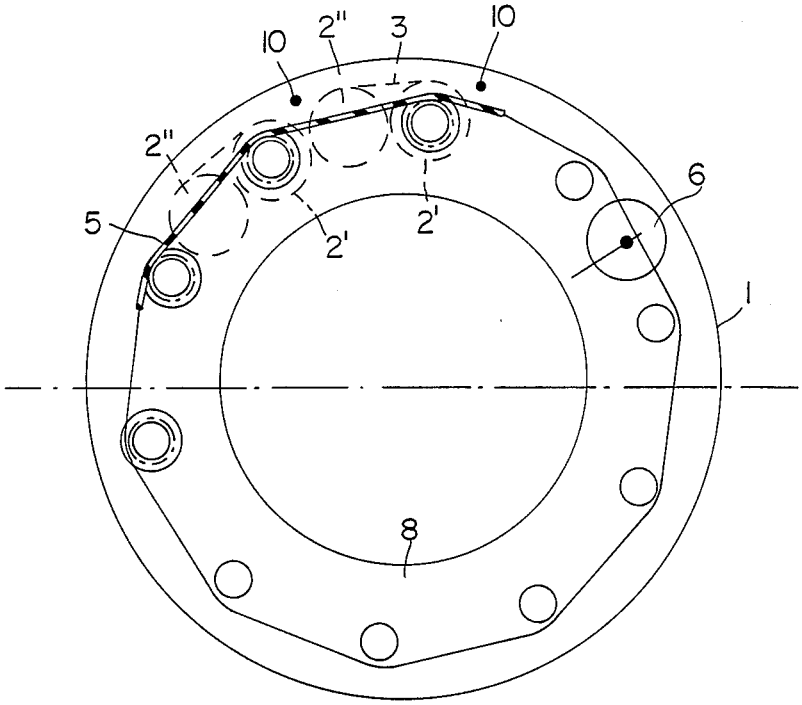
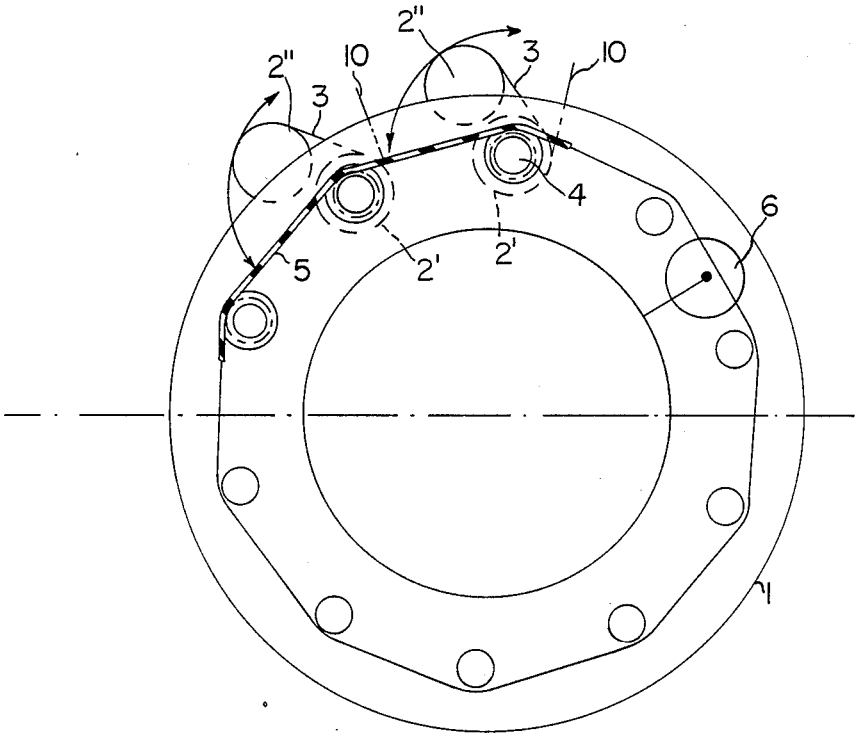
FIG. 1b

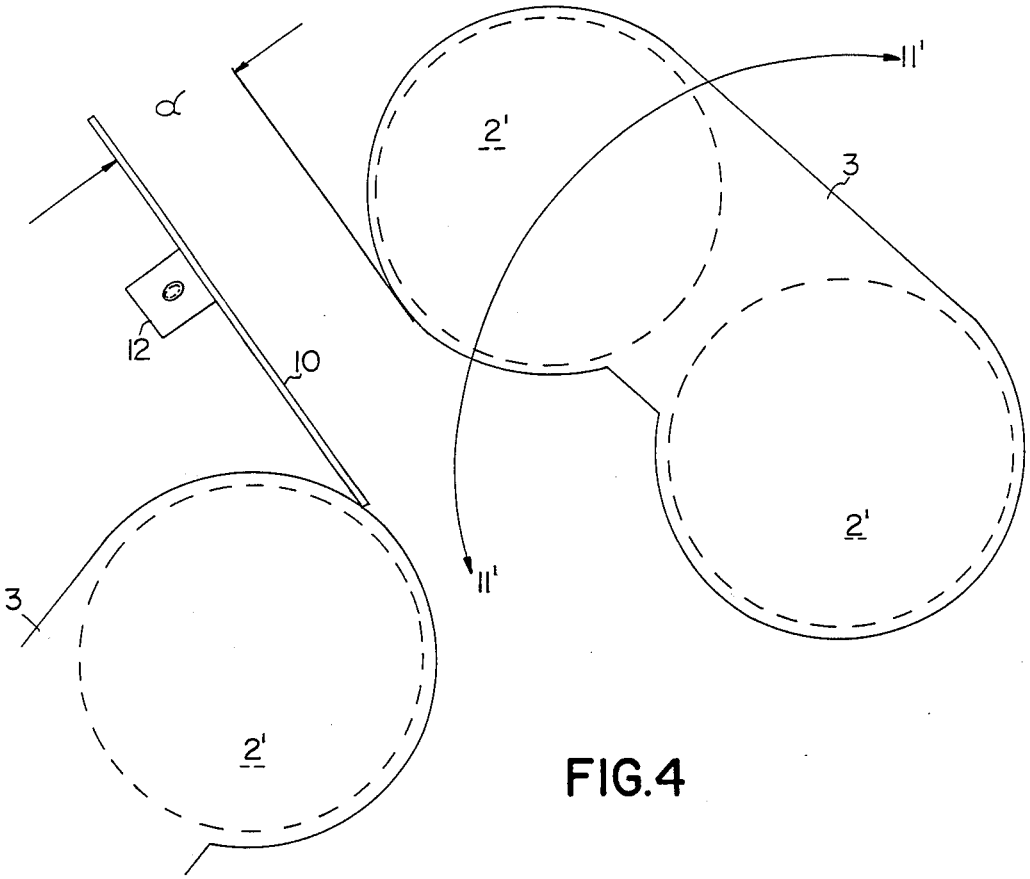
FIG.4
FIG.5
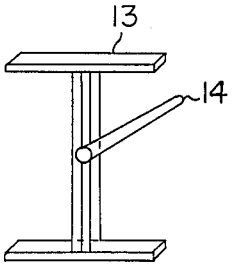

SEPARATING DRUM

BACKGROUND AND SUMMARY OF THE INVENTION

The present invention generally relates to a separating drum housing a multiple of cylindrically shaped separating elements which are arranged parallel to the axis of the drum to form a plurality of separating slots and more particularly to an arrangement to form an adjustable separating slot.

Separating drums of the type concerned here are employed to separate various and differing objects. For this reason, it is often necessary to alter the drum, i.e. reset the size of the separating slot situated on the circumference of the drum.

In the case of conventional commercial apparatuses, each separating slot must be set individually. Needless to say, this is not only troublesome, but also prone to errors. Considering that a large number of settings must be made, it can easily happen that one or more separating slots may be set for the wrong size.

Simple solutions for setting the size of the individual separating slots distributed around the circumference have hitherto been unknown.

Thus, it is an object of the present invention to improve a separating drum having a multiple of separating slots distributed around the circumference in such a manner that setting the slot size can occur centrally while still retaining a simple construction.

In accordance with advantageous features of preferred embodiments of the present invention, the separating drum has separating elements which are firmly connected in pairs respectively by means of at least one carrier element, which is provided on the front face of the separating element. The carrier element can be pivoted around the longitudinal axis of one of the pair of connected cylindrically shaped separating element situated in the circumference of the drum to form a rotatable and a pivotable separating element. Further, an adjusting wheel is provided which can be driven by a circling adjusting element to set the separating slot. The adjusting wheel being in the axis of pivot of the carrier element, preferably on at least one of the front faces of the rotatable separating element.

By this combination of features it is possible to reset the separating slot in a single adjustment operation by driving the circling adjusting element when the objects to be separated are changed.

The setting operation may be performed by hand as well as automatically via a process control unit.

As in any event the settings of all the separating slots are changed jointly and simultaneously, it is not necessary to check the dimensions of each individual separating slot, for which reason resetting is not only substantially simplified, but also sources of error in setting the size of the slots are eliminated.

According to one embodiment of the present invention, the adjusting wheel is a sprocket wheel and the adjusting element is a chain which can be driven by a driving means. Naturally, however, it is also possible to use a gear belt as the circling element or a similar circling element, such as, by way of illustration a V-belt; a chain, however, has economic advantages over the gear belt especially in the case of small series production.

According to another embodiment of the present invention, it is advantageous if the circling element can be fixed in such a manner that the setting of the separating slots cannot be altered during operation.

According to yet another embodiment of the present invention the cylindrically shaped separating elements are firmly attached, i.e. cannot rotate around their individual axes, to the carrier element. It is particularly advantageous to realize the invented arrangement in separating drums of this type as, by way of illustration, it results in a simple construction of the carrier element.

By yet a further embodiment of the present invention the pivotable separating element is positioned adjacent a separating lamina firmly attached to the drum to form the separating slot. This arrangement ensures that objects of complicated shape, by way of example having lugs or the like, cannot catch in the separating arrangement.

Other objects, advantages and novel features of the present invention will become apparent from the following detailed description of the invention when considered in conjunction with the accompanying drawings.

BRIEF DESCRIPTION OF THE DRAWINGS

FIGS. 1*a* and *b* show a front view of a separating drum having a variable slot setting, in accordance with the teachings of the present invention.

FIG. 4 shows a separating slot in accordance with one embodiment of the present invention.

DETAILED DESCRIPTION OF THE DRAWINGS

The present invention is made more apparent in the following section using a preferred embodiment with reference to the accompanying drawings.

FIGS. 1*a* and *b* depict a front view of a separating drum 1 of the present invention for separating objects (not shown in FIG. 1). The separating drum 1 is provided with a plurality of cylindrically shaped separating elements 2' and 2'' on the surface of the circumference of drum 1. Preferably, the separating elements 2', 2'' are rotatably fixed in such a manner that they are not able to rotate around their individual longitudinal axes and., thus form stationary roller cylinders.

Figure 2:
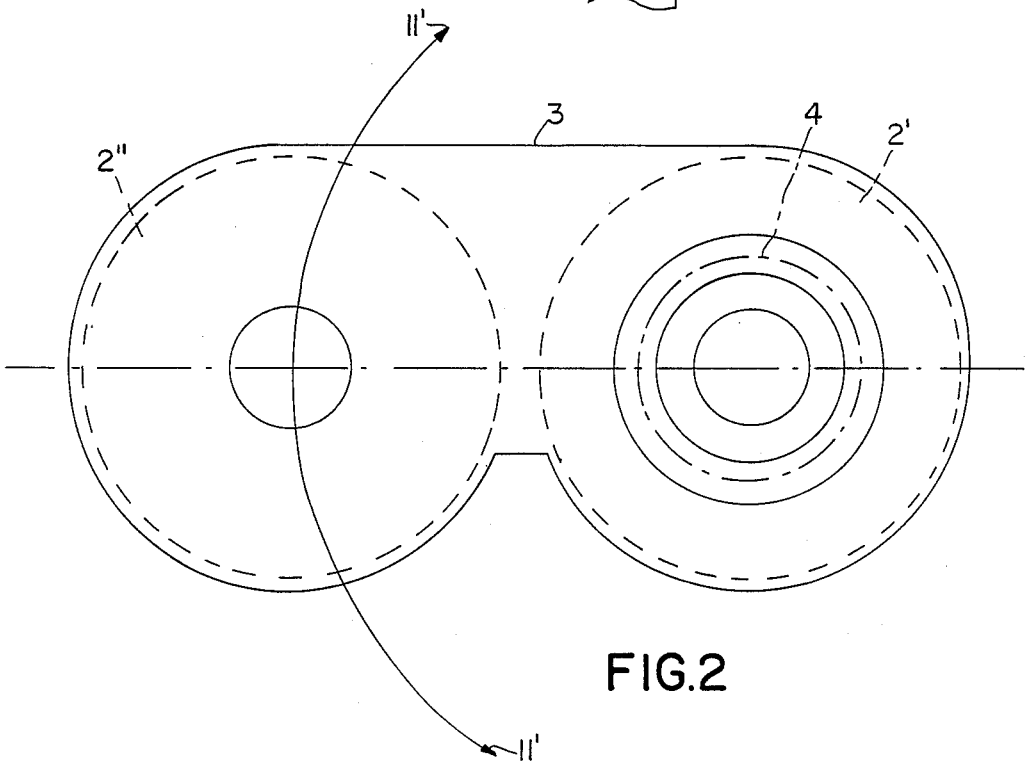
FIG. 2 shows a carrier element designed according to the teachings of the present invention for a separating pair.

Separating element 2' and element 2'' are connected by a carrier element 3, illustrated in more detail in FIG. 2. Carrier element 3 is preferably mounted on the front surface 8 of the separating drum 1 in such a manner that it can pivot about the longitudinal axis of element 2' to form a rotatable separating element 2' and a pivotable separating element 2''which pivots about the axis of the rotation of the rotatable separating element 2' as best seen in FIG. 2. A sprocket wheel 4 is firmly connected to carrier element 3 or rotatable separating element 2'. A chain 5 is stretched over the sprocket wheels 4 of the individual carrier elements 3 distributed over the circumference of drum 1 and can be driven by means of a driving means, not shown in detail herein.

Figure 3:
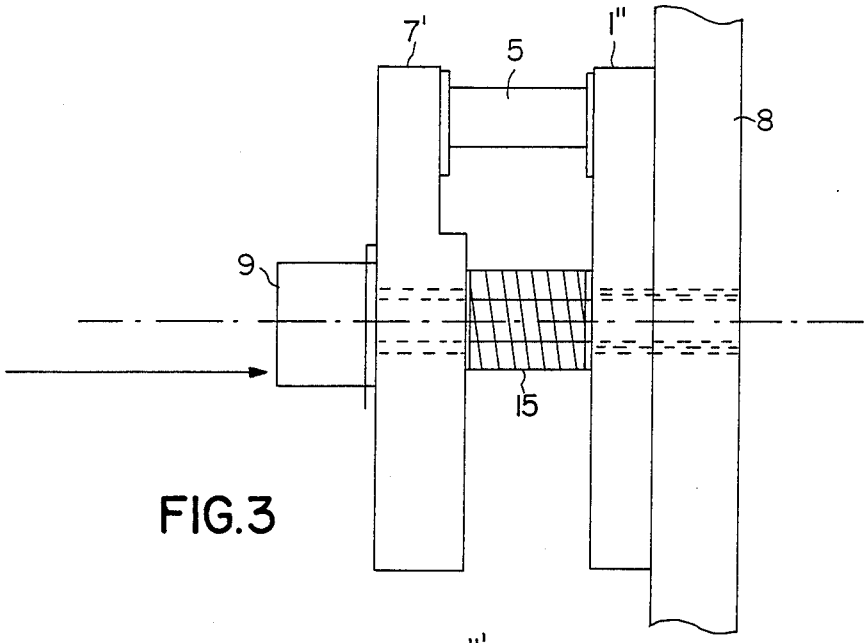
FIG. 3 shows a fixing element for a chain.

Furthermore, chain 5 can be fixed by a brake element 6, which is illustrated in more detail in FIG. 3. Element 6 is provided for this purpose with two clamping disks 7' and 7'' for chain 5, which are connected by, for example, a hexagonal socket head screw 9 screwed to the front wall 8 of drum 1 and which can be pressed apart by a spring 15. The chain can be clamped fast by tightening screw 9, whereas if screw 9 is loosened, chain 5 runs freely through the fixing element 6.

Moreover, the separating drum 1 is provided with separating lamina 10 which are firmly attached to the drum housing by a strip 12 and which are arranged opposite and adjacent the pivotable separating element 2'' in each separating slot as best seen in FIGS. 1*a*, 1*b* and FIG. 4.

The mode of operation of the separating drum 1 is made more apparent in the following description with reference to FIGS. 2 and 4.

Sprocket wheel 4, which is allocated to each carrier element 3, is turned by turning chain 5 in the one or the other direction, thereby swinging the carrier element 3 in the direction of arrows 11' and 11'' as seen in FIGS. 2 and 4. By this means, width d of all the separating slots formed between the separating lamina 10 and pivotable elements 2'' can be made larger or smaller to the same degree. As all the sprocket wheels 4 are connected via chain 5, changing the individual separating slots occurs synchronically and centrally by a driving means (not shown in detail) for the chain, which may be built like a conventional chain drive. At the same time, the invented arrangement of the cylindrical roller slot between the pivotable separating element 2'' and lamina 10 makes it possible to separate even objects to be separated of complicated shape (13), such as the "H-shaped" object with the cast lug 14 illustrated in FIG. 4, without catching in the slot.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A rotatable separating drum having cylindrically shaped separating elements each having a longitudinal axis arranged parallel to an axis of rotation of the drum comprising (a) at least one carrier element, pivotably affixed to the separating drum, for firmly connecting adjacent cylindrically shaped separating elements in pairs, the at least one carrier element having an axis of pivot coaxial with the longitudinal axis of one of the pair of separating elements connected by the at least one carrier element, to form a rotatable separating element which is rotatable about the longitudinal axis thereof and a pivotable separating element which is pivotable about the axis of rotation of the rotatable separating element;

(b) an adjustable separating slot formed between adjacent pairs of connected separating elements; and (c) an adjustment wheel affixed to at least one of the carrier element and the rotatable separating element, the adjustment wheel having an axis of rotation coaxial with the axis of rotation of the at least one carrier element; and (d) a drive means for rotatably driving the adjustment wheel to set the separation slot.

2. A separating drum according to claim 1, wherein the adjustment wheel is a sprocket wheel and the adjustment element is a chain, which is driven by a driving means.

3. A separating drum according to claim 2, wherein a brake means is provided to fix the chain.

4. A separating drum according to claim 1 wherein said cylindrically shaped separating elements are firmly attached to said carrier element.

5. A separating drum according to claim 2 wherein said cylindrically shaped separating elements are firmly attached to said carrier element.

6. A separating drum according to claim 3 wherein said cylindrically shaped separating elements are firmly attached to said carrier element.

7. A separating drum according to claim 1, further comprising a separating lamina which is firmly attached to the drum, wherein the pivotable separating element and the separating lamina form said separating slot.

8. A separating drum according to claim 2, further comprising a separating lamina which is firmly attached to the drum, wherein the pivotable separating element and the separating lamina form said separating slot.

9. A separating drum according to claim 3, further comprising a separating lamina which is firmly attached to the drum, wherein the pivotable separating element and the separating lamina form said separating slot.

10. A separating drum according to claim 4, further comprising a separating lamina which is firmly attached to the drum, wherein the pivotable separating element and the separating lamina form said separating slot.

* * * * *